US005602084A

United States Patent [19]

Moreton

[11] Patent Number: 5,602,084

[45] Date of Patent: Feb. 11, 1997

[54] DETERGENT ADDITIVES FOR LUBRICATING OILS, THEIR PREPARATION AND USE

[75] Inventor: David J. Moreton, Hull, United Kingdom

[73] Assignee: BP Chemicals (Additives) Limited, London, England

[21] Appl. No.: 449,773

[22] Filed: May 24, 1995

[30] Foreign Application Priority Data

Jun. 3, 1994 [GB] United Kingdom ..... 9411093

[51] Int. Cl.[6] ..... C10M 159/20

[52] U.S. Cl. ..... 508/391; 508/460; 508/585; 508/586

[58] Field of Search ..... 252/42.7, 18, 25

[56] References Cited

U.S. PATENT DOCUMENTS

| | | | |
|---|---|---|---|
| 2,695,910 | 11/1954 | Asseff et al. | 260/413 |
| 5,114,601 | 5/1992 | Cook et al. | 252/25 |
| 5,162,085 | 11/1992 | Cane et al. | 252/42.7 |
| 5,202,036 | 4/1993 | Ripple et al. | 252/33.4 |
| 5,205,946 | 4/1993 | Cook et al. | 252/25 |
| 5,397,484 | 3/1995 | Cane et al. | 252/42.7 |

FOREIGN PATENT DOCUMENTS

| | | |
|---|---|---|
| 0014801 | 9/1980 | European Pat. Off. . |
| 0271262 | 6/1988 | European Pat. Off. . |
| 0347103 | 12/1989 | European Pat. Off. . |
| 0450874A3 | 10/1991 | European Pat. Off. . |

*Primary Examiner*—Ellen M. McAvoy
*Attorney, Agent, or Firm*—Nixon & Vanderhye

[57] ABSTRACT

An additive concentrate preferably having a TBN greater than 300 suitable for incorporation in a finished lubricating oil composition, the additive concentrate comprising (a) a lubricating oil, and (b) a lubricating oil soluble detergent which is an overbased metal salt obtained by an overbasing process including a carbonation step and modified by reaction to incorporate from greater than 2 to less than 40% by weight based on the weight of the concentrate of either (i) at least one carboxylic acid having the formula (I):

(I)

wherein R is a $C_{10}$ to $C_{24}$ alkyl or alkenyl group and $R^1$ is hydrogen, a $C_1$ to $C_4$ alkyl group or a $—CH_2—COOH$ group, or an anhydride or an ester derivative thereof, or (ii) a di- or polycarboxylic acid containing from 36 to 100 carbon atoms or an anhydride or an ester thereof, and further modified to incorporate by addition prior to carbonation a hindered phenol or naphthol having antioxidant activity.

32 Claims, No Drawings

DETERGENT ADDITIVES FOR LUBRICATING OILS, THEIR PREPARATION AND USE

The present invention relates in general to detergent additives for lubricating oils, their preparation and their use.

In the internal combustion engine, by-products from the combustion chamber often blow by the piston and admix with the lubricating oil. Many of these by-products form acidic materials within the lubricating oil. This is particularly marked in diesel engines operating on low-grade fuels of high sulphur content wherein corrosive acids are produced by combustion. The acids thereby incorporated in the lubricating oil can include sulphur acids produced by oxidation of sulphur, hydrohalic acids derived from halogen lead scavengers in the fuel and nitrogen acids produced by the oxidation of atmospheric nitrogen within the combustion chamber. Such acids cause deposition of sludge and corrosion of the bearings and engine parts leading to rapid wear and early breakdown of the engine.

Compounds generally employed to neutralise the acidic materials and disperse sludge within the lubricating oils are generally referred to as detergents. Compounds commonly employed as detergents are the alkaline earth metal salts of phenols, sulphonic acids, salicylic acids and carboxylic acids, for example naphthenic acids and stearic acid. Other compounds suggested for use as detergents are the alkaline earth metal salts of calixarenes and linear phenol/formaldelyde resins, eg. Resole and Novolak resins. Both "normal" and "overbased" alkaline earth metal salts have been employed. The term "overbased" is used to describe those alkaline earth metal salts in which the ratio of the number of equivalents of the alkaline earth moiety to the number of equivalents of the acidic moiety, ie. phenol, sulphonic acid, etc., is greater than one, and is usually greater than 1.2 and may be as high as 4.5 or greater. In contrast, the equivalent ratio of alkaline earth metal moiety to acidic moiety in "normal" salts is one. Thus the "overbased" material can contain greater than 20% in excess of the alkaline earth metal present in the corresponding normal material. For this reason "overbased" alkaline earth metal salts have a greater capability for neutralising acidic matter than do the corresponding "normal" alkaline earth metal salts. The term overbasing in the context of producing highly overbased detergents is well-known in the art to involve a carbonation step, which can, if desired, be facilitated by a carbonation catalyst.

A measure of a detergent's capability to neutralise acidic matter within lubricating oils is its Total Base Number (TBN) expressed in mg KOH/g as measured by the method of ASTM D2896. Generally the higher the TBN of a detergent the greater is its capability for neutralising acidic matter. We have found that the preparation of high TBN (ie. TBN's greater than 300) detergent/lubricating oil cencentrates having an acceptable viscosity (ie. a viscosity measured at 100° C. of less than 1000 cst) is facilitated by including as an essential reaction component either (i) at least one carboxylic acid having the formula:

$$R-\underset{\underset{R^1}{|}}{CH}-COOH \qquad (I)$$

wherein R is a $C_{10}$ to $C_{24}$ alkyl or alkenyl group and $R^1$ is either hydrogen, a $C_1$ to $C_4$ alkyl group or a $—CH_2$ COOH group or an anhydride, acid chloride or ester thereof, for example stearic acid, generally in an amount in the range of from 2 to 40% by weight based on the weight of the concentrate or (ii) a di- or poly- carboxylic acid containing from 36 to 100 carbon atoms or an anhydride or an ester thereof. Thus, the production of high TBN concentrates having an acceptable viscosity is described in our European Applications Publication Numbers 271262 (hydrocarbyl phenates); 273588 (hydrocarbyl phenates); 351053 (hydrocarbyl sulphonates); 351052 (hydrocarbyl salicylates); 347103 (mixed hydrocarbyl phenates, salicylates, sulphonates and naphthenates) and 450874 (calixarates).

For maximum effectiveness modern lubricating oil additives, in addition to performing their primary intended function desirably provide other properties. Thus, detergents, whilst functioning to neutralise acidic matter and disperse sludge, desirably provide some measure of antioxidancy and/or antiwear, for example. Whilst the high TBN detergents described hereinbefore perform very well in the neutralisation of acidic matter and dispersal of sludge there remains scope for improvement in for example their antioxidancy properties. We have found that this problem can be overcome by modifying the metal salt detergent with a hindered phenol or napththol having antioxidant activity.

Accordingly the present invention provides an additive concentrate suitable for incorporation in a finished lubricating oil composition, the additive concentrate comprising:

(a) a lubricating oil, and (b) a lubricating oil soluble detergent which is an overbased metal salt obtained by an overbasing process including a carbonation step and modified by reaction to incorporate from greater than 2 to less than 40% by weight based on the weight of the concentrate of either (i) at least one carboxylic acid having the formula:

$$R-\underset{\underset{R^1}{|}}{CH}-COOH \qquad (I)$$

wherein R is a $C_{10}$ to $C_{24}$ alkyl or alkenyl group and $R^1$ is hydrogen, a $C_1$ to $C_4$ alkyl group or a $—CH_2—$COOH group, or an anhydride or an ester derivative thereof, or (ii) a di-or polycarboxylic acid containing from 36 to 100 carbon atoms or an anhydride or an ester thereof, and further modified to incorporate by addition prior to carbonation a hindered phenol or naphthol having antioxidant activity.

Addition of the hindered phenol or naphthol in the overbasing process prior to carbonation is believed to result in its chemical modification possibly by incorporation into the structure of the material being overbased, though the precise manner of such chemical modification is not yet fully understood. It is to be distinguished from its addition after overbasing which forms no part of the present invention. Addition after overbasing is believed to result in a physical blend of the hindered phenol or naphthol with the overbased metal salt. Such beliefs however are not to be interpreted as binding in relation to the invention.

The TBN of the concentrate is preferably greater than 300, for example greater than 350, typically greater than 400. The viscosity of the concentrate as measured at 100° C. is preferably less than 1000 cst, for example less than 750 cst, typically less than 500 cst.

Component (a) of the additive concentrate is a lubricating oil. The lubricating oil is suitably an animal oil, a vegetable oil or a mineral oil, such as a naphthenic base, paraffin base or mixed base oil. Suitably the lubricating oil is a petroleum-derived lubricating oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tridecyladipate, or polymeric hydrocarbon lubricating oils, for example liquid polyisobutenes and poly-alpha olefins. The lubricating oil may suitably comprise from 10 to 90%, typically from 10 to 70%, for example from 15 to 35% by weight of the concentrate.

Component (b) of the additive concentrate is a modified lubricating oil soluble overbased metal salt detergent. Suitably the detergent is an overbased metal salt of at least one of either (1) a hydrocarbyl-substituted phenol, (2) a sulphur-free calixarene having a substituent hydroxyl group or groups available for reaction with metal base, (3) a linear phenol/formaldehyde condensation product, (4) a hydrocarbyl-substituted sulphonic acid, (5) a hydrocarbyl-substituted naphthenic acid, or (6) a hydrocarbyl-substituted salicylic acid or (7) a condensation product of either a hydrocarbyl-substituted sulphonic acid or a hydrocarbyl-substituted salicylic acid and an aldehyde.

The metal of the overbased metal salt is suitably an alkali or an alkaline earth metal, preferably an alkaline earth metal, more preferably either calcium, magnesium or barium, most preferably calcium. Suitably the metal may be present in an amount in the range from 10 to 20% by weight based on the weight of the concentrate.

As regards the hydrocarbyl-substituted phenol (1), the phenol may be mono-or poly-substituted, or may be a mixture thereof. The hydrocarbyl-substituent is suitably an alkyl group or groups. Suitable alkyl groups contain from 4 to 50, preferably from 9 to 28 carbon atoms. A particularly suitable alkyl phenol is the $C_{12}$-alkyl phenol resulting from the alkylation of phenol with propylene tetramer. In addition to paradodecyl phenol such a product may contain up to 40% by weight of other alkylation products including didodecylphenol for example. Other preferred alkyl phenols include substantially pure paradodecyl phenol and octadecyl phenol. The phenol may be either sulphurised or non-sulphurised.

As regards the sulphur-free calixarene having a substituent hydroxyl group or groups available for reaction with metal base (2), this may be represented by the formula:

(II)

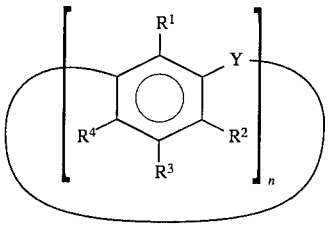

wherein

Y is a divalent bridging group:

$R^3$ is hydrogen, a hydrocarbyl or a hetero-substituted hydrocarbyl group;

either $R^1$ is hydroxyl and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; and n is an integer in the range from 4 to 20, for example from 3 to 12.

In the formula (II), Y may suitably be $(CHR^6)_d$ in which $R^6$ is either hydrogen or hydrocarbyl eg. of 1–6 carbons such as methyl and d is an integer which is at least one, n preferably is from 4 to 9. Any hetero-substituted hydrocarbyl group has the heteroatom preferably O or NH interrupting a chain of carbon atoms, such as an alkoxy-alkyl group of 2–20 carbons.

A preferred calixarene has the formula:

(III)

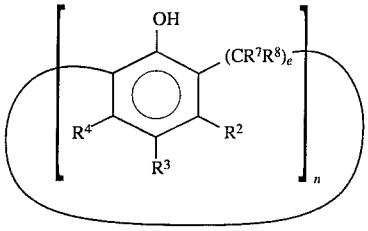

wherein $R^2$, $R^3$ and $R^4$ are independently either hydrogen, hydrocarbyl or hetero-substituted hydrocarbyl, either one of $R^7$ and $R^8$ is hydrogen and the other is either hydrogen or hydrocarbyl, n is an integer in the range 4 to 20, for example 3 to 12, preferably 4 to 9, and e is one or greater eg. 1–4.

Preferably in the formula (III), $R^2$ and $R^4$ are hydrogen, $R^3$ is hydrocarbyl eg. of 1–20 such as 3–16 carbon atoms or hetero-substituted hydrocarbyl, more preferably alkyl, one of $R^7$ or $R^8$ is hydrogen and the other is either hydrogen or alkyl, n is either 4, 6 or 8 and e is one. In the case where one of $R^7$ and $R^8$ is alkyl, it is preferably $C_1$–$C_4$ alkyl, more preferably methyl. Preferably $R^3$ is alkyl, in particular nonyl (or a propylene trimer), t-butyl, dodecyl or tertiary-amyl. p-Alkylcalixarenes are also known as p-alkylphenol calixarenes and both terms will be used herein. An example of a suitable calixarene of the formula (II) is p-tert-butyl calix [6,8] arene. The [8] arene, for example, may be represented by the formula:

(IV)

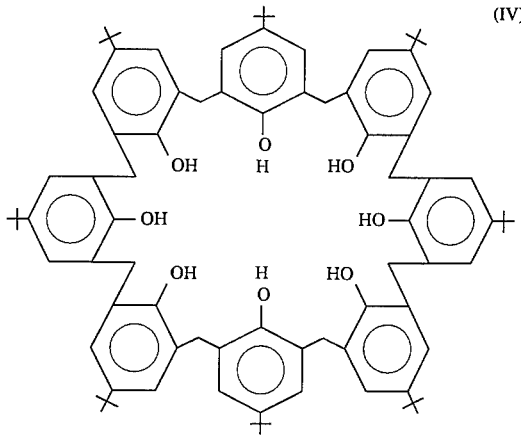

Other suitable calixarenes include p-dodecyl calix[6] arene, p-nonyl calix[8]arene and p-nonyl[6,7,8]arene. A preferred calixarene is p-dodecyl[6,7,8]arene. Another preferred calixarene is p-dodecylcalix(11)arene. Yet further suitable calixarenes include para-octadecyl calixarene and a para —$C_{30}$ calixarene wherein the $C_{30}$ substituent is derived from a high vinylidene polyisobutene.

Dodecyl calixarenes may be derived from substantially pure paradodecyl phenols or impure dodecylphenols such as those generally obtained by the alkylation of phenol with propylene tetramer. Preferred dodecylcalixarenes are obtained from substantially pure, paradodecyl phenols, which are commercially available from, for example, Schenectady.

Calixarenes may suitably be prepared by the method described in 'Monographs in Supramolecular Chemistry' by C David Gutsche, Series Editor—J Fraser Stoddart, published by the Royal Society of Chemistry, 1989. Typically, an alkyl phenol unsubstituted at the ortho-positions may be reacted in the presence of a base with an aldehyde, such as formaldehyde or acetaldehyde.

As regards the linear phenol/formaldehyde condensation product (3), this may suitably have the formula:

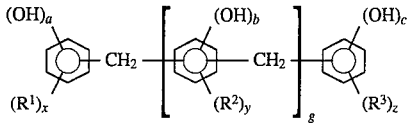

(V)

wherein a, b and c each independently represent 1 or 2;

x, y and z each independently represent zero or an integer from 1 to 3;

$R^1$, $R^2$ and $R^3$ independently represent either hydrogen or a hydrocarbyl group, when x, y or z is greater than unity, each $R^1$, each $R^2$ or each $R^3$ respectively being the same or different; and g is an integer in the range from 1 to 20.

Preferred compounds of the formula (V) are those in which a, b and c are 1; x, y and z are 1; $R^1=R^2=R^3=C_1$ to $C_{24}$ alkyl, preferably $C_1$ to $C_{12}$ alkyl; and g is preferably from 2 to 7, more preferably 3.

As regards the hydrocarbyl-substituted sulphonic acid (4), the hydrocarbyl-substituent may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl and radicals derived from the polymerisation of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is either propene, 1-butene or isobutene.

As regards the hydrocarbyl-substituted naphthenic acid (5) and the hydrocarbyl-substituted salicylic acid (6), the hydrocarbyl-substituents may be as described hereinbefore in relation to the hydrocarbyl-substituted sulphonic acid.

As regards (7) the condensation product of a hydrocarbyl-substituted sulphonic acid or salicylic acid is preferably the condensation product of the acid with formaldehyde.

Of the overbased metal salts described hereinbefore preferred are the sulphurised or non-sulphurised phenol (1), the calixarene (2) and the linear phenol/formaldehyde condensation product (3) or mixtures of two or more thereof.

The overbased metal salt is modified by reaction to incorporate from greater than 2 to less than 40% by weight based on the weight of the concentrate of either (i) at least one carboxylic acid having the formula (I) or an anhydride or an ester derivative thereof, or (ii) a di-or polycarboxylic acid containing from 36 to 100 carbon atoms or an anhydride or an ester thereof. Preferably the carboxylic acid having the formula (I), the di-or polycarboxylic acid, or the acid anhydride or ester thereof is incorporated in an amount from greater than 10 to 35%, more preferably from 12 to 20%, for example about 16% by weight based on the weight of the concentrate.

As regards (i) this is at least one carboxylic acid having the formula (I), or an anhydride or ester thereof. Preferably R in the formula (I) is an unbranched alkyl or alkenyl group. Preferred acids of formula (I) are those wherein R is a $C_{10}$ to $C_{24}$ , more preferably $C_{18}$ to $C_{24}$ straight-chain alkyl group and $R^1$ is hydrogen. Examples of suitable saturated carboxylic acids of formula (I) include capric acid, lauric acid, myristic acid, palmitic acid, stearic acid, arachidic acid, behenic acid and lignoceric acid. Examples of suitable unsaturated acids of formula (I) include lauroleic acid, myristoleic acid, palmitoleic acid, oleic acid, gadoleic acid, erucic acid, ricinoleic acid, linoleic acid and linolenic acid. Mixtures of acids may also be employed, for example rape top fatty acid. Particularly suitable mixtures of acids are those commercial grades containing a range of acids, including both saturated and unsaturated acids. Such mixtures may be obtained synthetically or may be derived from natural products, for example resin and tall oil (both from pine trees) cotton oil, ground nut oil, coconut oil, linseed oil, palm kernel oil, olive oil, corn oil, palm oil, castor oil, soyabean oil, sunflower oil, herring oil, sardine oil and tallow. Sulphurised acids and acid mixtures may also be employed. Instead of, or in addition to, the carboxylic acid there may be used the acid anhydride, or the ester derivatives of the acid, preferably the acid anhydride. It is preferred however to use a carboxylic acid or a mixture of carboxylic acids. A preferred carboxylic acid of formula (I) is stearic acid. As regards (ii) this is preferably a polyisobutene succinic acid or a polyisobutene succinic anhydride.

Of the carboxylic acids having the formula (I) and the di-or polycarboxylic acid, the carboxylic acid having the formula (I) is preferred and of the carboxylic acids stearic acid is preferred.

The detergent is further modified to incorporate by addition prior to carbonation a hindered phenol or naphthol having antioxidant activity. Of the phenol or naphthol the phenol is preferred.

As regards the hindered phenols, these may be mononuclear or polynuclear. Suitable mononuclear phenols have the formula:

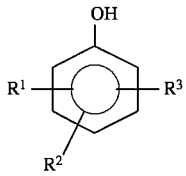

(VI)

wherein $R^1$ and $R^2$ are independently hydrocarbyl groups, suitably alkyl, and $R^3$ is a hydrocarbyl group, suitably alkyl, or hydrogen. Preferably at least one, more preferably at least two of $R^1$, $R^2$ and $R^3$ are bulky alkyl groups, for example tertiary alkyl groups, such as tertiary-butyl groups, and the remaining one (if any) is either a lower alkyl group, for example methyl, ethyl or propyl, or hydrogen. An example of a suitable mononuclear phenol having the formula (VI) is 2,6-di-tert-butyl-4-methyl phenol, which is available commercially as BHT (butylated hydroxy toluene). A useful class of mononuclear phenols having the formula (VI) is the di-tert-butyl phenols, for example 3,5-di-tert-butyl phenol; 2,4-di-tert-butylphenol and 2,6-di-tert-butylphenol, which are available commercially. Of these 3,5-di-tert-butylphenol and 2,6-di-tert-butylphenol are preferred, 2,6-di-tert-butylphenol being most preferred on the ground that it is cheaper.

Alternatively, there may be used polynuclear phenols, for example bisphenols and diphenols. Suitable bisphenols and diphenols have the formula:

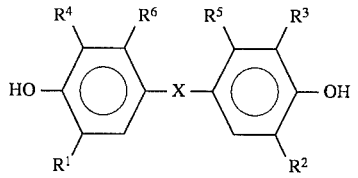

(VII)

wherein

X=either $CH_2$, $CR^5R^6$ wherein $R^5$ and $R^6$ are independently alkyl groups or one of $R^5$ and $R^6$ is H and the other alkyl, or sulphur, or X is a single bond linking the two phenol nuclei;

$R^1$ and $R^2$ which may be the same or different, preferably the same, are alkyl;

$R^3$ and $R^4$ which may be the same or different, preferably the same, are H or alkyl;

$R^5$ and $R^6$ which may be the same or different, preferably the same, are either H or alkyl.

Examples of suitable bisphenols having the formula (VII) are 4,4'-butylidenebis-(6-tert-butyl-3-methyl)phenol ($X=HCC_3H_7$; $R^1=R^2=$t-butyl; and $R^3=R^4=H$) known commercially as Santowhite Powder and 4,4'-thiobis (2-tert-butyl-5-methyl)phenol (X=S; $R^1=R^2=$t-butyl; $R^3=R^4=H$; and $R^5=R^6=CH_3$) known commercially as Santonox R. Examples of other suitable hindered phenols include 2,2'-methylene-bis (4-methyl-6-tert-butyl) phenol of the formula:

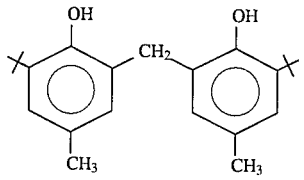

(VIII)

that commercially known as Ethanox 330 of the formula:

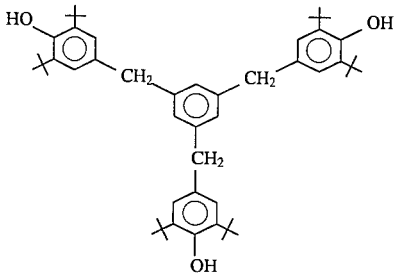

(IX)

tetrakis [methylene (3,5-di-tert-butyl-4-hydroxyhydro-cinnamate)]methane of the formula:

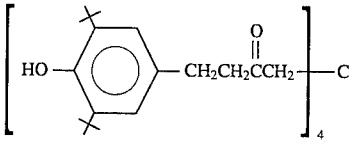

(X)

known commercially as Irganox 1010.

Nitrogen-containing bisphenols may also be employed, for example N,N'-1,6-hexamethylene-bis-3-(3,5-di-tert-butyl-4-hydroxyphenol)propianamide of the formula:

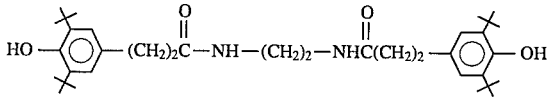

known commercially as Irganox 1098.

Alternatively when X in the formula (VII) is a single bond linking the two phenolic nuclei the hindered phenol is a diphenol.

The hindered phenol or naphthol may suitably be present in an amount sufficient to replace up to 40 mole %, typically up to 20 mole %, for example up to 10 mole % of the hydrocarbyl-substituted phenol, sulphonic acid, naphthenic acid or salicylic acid moieties of the detergents.

A preferred additive concentrate has a TBN of 350 or greater, preferably 400 or greater, and comprises from 10 to 70%, preferably from 15 to 35% by weight of the lubricating oil (a) and from 30 to 90%, preferably from 65 to 85%, of the component (b) of which from 2 to 40% comprises carboxylic acid (b) (i) or di- or polycarboxylic acid (b) (ii), from 5 to 40% of at least one of the hydrocarbyl-substituted phenol, the sulphur-free calixarene, the linear phenol/formaldehyde condensation product, the hydrocarbon-substituted sulphonic acid, the hydrocarbyl-substituted naphthenic acid or the hydrocarbyl-substituted salicylic acid plus hindered phenol or naphthol and from 10 to 20% of the alkaline earth metal, all percentages being by weight based on the weight of the concentrate.

A particularly preferred concentrate has a TBN of 400 or greater and comprises from 15 to 35%, more preferably 15 to 20%, lubricating oil; from 5 to 30%, more preferably from 15 to 20%, dodecylcalixarene wherein from 5 to 30 mole %, preferably from 18 to 22 mole %, of the dodecylcalixarene is replaced by 2,6-di-tertiary butylphenol; from 10 to 35%, preferably from 25 to 30% of a carboxylic acid having the formula (I) wherein R is a $C_{18}$–$C_{24}$ straight-chain alkyl group and $R^1$ is hydrogen, preferably stearic acid; and from 10 to 20%, preferably from 14 to 16% alkaline earth metal, preferably calcium, all percentages other than that of the 2,6-di-tertiary butyl phenol, being by weight based on the weight of the concentrate.

In another aspect the present invention provides a process for the production of an additive concentrate as hereinbefore described which process comprises reacting at elevated temperature:

Component (A') at least one of (i) at least one of a sulphurised hydrocarbyl-substituted phenol, sulphonic acid, salicylic acid or naphthenic acid, (ii) at least one of a non-sulphurised hydrocarbyl-substituted phenol, sulphonic acid, salicylic acid or naphthenic acid, (iii) at least one of a non-sulphurised hydrocarbyl-substituted phenol, sulphonic acid, salicylic acid or naphthenic acid and a source of sulphur, (iv) at least one sulphurised or non-sulphurised hydrocarbyl-substituted phenate, sulphonate, salicylate or naphthenate having a TBN lower than that of the concentrate, (v) at least one calixarene product obtained by reacting a hydrocarbyl-substituted phenol unsubstituted at the ortho-positions, an aldehyde and as catalyst for the reaction a base, (vi) at least one calixarate having a TBN lower than that of the concentrate, (vii) at least one linear phenol/formaldehyde product obtained by reacting a mixture comprising a hydrocarbyl-substituted phenol, formaldehyde and as catalyst for the reaction a base, (viii) at least one metal salt of a linear phenol/formaldehyde product having a TBN lower than that of the concentrate (ix) the product obtained by reacting either a hydrocarbyl-substituted sulphonic acid or salicylic acid, an aldehyde and as catalyst for the reaction a base, or (x) at least one metal salt of the product of (ix) having a TBN lower than that of the concentrate;

component (A") a hindered phenol or naphthol having antioxidant activity;

component (B') a metal base added either in a single addition or in a plurality of additions at intermediate points during the reaction;

component (C') a solvent comprising either:

(1) either:

(i) a polyhydric alcohol having 2 to 4 carbon atoms, (ii) a di-($C_3$ or $C_4$)glycol, (iii) a tri-($C_2$–$C_4$)glycol, or (iv) a mono- or poly-alkylene glycol alkyl ether of the formula:

$$R(OR^1)_xOR^2 \quad (XI)$$

wherein in the formula (XI) R is a $C_1$ to $C_6$ alkyl group, $R^1$ is an alkylene group, $R^2$ is hydrogen or a $C_1$ to $C_6$ alkyl group and x is an integer of from 1 to 6, either alone or in combination with either (2) a hydrocarbon solvent or (3) either (a) water, (b) a $C_1$ to $C_{20}$ monohydric alcohol, (c) a ketone containing up to 20 carbon atoms, (d) a carboxylic acid ester containing up to 10 carbon atoms or (e) an aliphatic, alicyclic or aromatic ether containing tip to 20 carbon atoms or, (4) a $C_1$ to $C_4$ monohydric alcohol in combination with a hydrocarbon solvent (2);

component (D') a lubricating oil;

component (E') carbon dioxide added subsequent to each addition of component (B');

component (F') either (i) at least one carboxylic acid having the formula:

$$R-\underset{\underset{R^1}{|}}{CH}-COOH \quad (I)$$

wherein R is a $C_{10}$ to $C_{24}$ alkyl or alkenyl group and $R^3$ is hydrogen, a $C_1$ to $C_4$ alkyl group or a —$CH_2$—COOH group, or an anhydride or an ester derivative thereof, or (ii) a di- or polycarboxylic acid containing from 36 to 100 carbon atoms or an anhydride or an ester thereof, optional component (G') a catalyst for the carbonation reaction;

provided that components (A') (A"), (B'), (C'), (F') and optional component (G') are added prior to addition of component (E').

As regards component (A') with regard to (i) to (iv) suitable hydrocarbyl-substituted phenols, sulphonic acids, salicylic acids and naphthenic acids are as hereinbefore described in relation to component (b) of the additive concentrate. With regard to (v) and (vi) suitable hydrocarbyl-substituted phenols unsubstituted at the ortho-positions are as hereinbefore described in relation to the aromatic moiety of the calixarenes of the formulae (II) and (III), Again with reference to the formulae (II) and (III) suitable aldehydes have the formula YO. A preferred aldehyde is formaldehyde, which may be used in any of its forms, for example paraformaldehyde. As the base catalyst for the production of the calixarene any suitable base may be employed. Suitable bases include the alkaline earth metal bases, for example calcium oxide or hydroxide, or a mixture thereof. With regard to (vii) and (viii) suitable hydrocarbyl-substituted phenols are as hereinbefore described in relation to the aromatic moieties of the phenol/formaldehyde condensation product of the formula (IV). Suitable bases are those described in relation to the calixarene product of (A') (v) and (vi). Suitable hindered phenols or naphthols (A") are as hereinbefore described in relation to component (b) of the additive concentrate.

Component (B') is a metal base added either in a single addition or in a plurality of additions at intermediate points during the reaction. The metal may suitably be either an alkali metal or an alkaline earth metal, preferably an alkaline earth metal more preferably calcium, magnesium or barium, or barium, or most preferably calcium. The base moiety may suitably be an oxide or a hydroxide, preferably the hydroxide. A calcium base may be added, for example, in the form of quick lime (CaO) or in the form of slaked lime.

Component (C') is a solvent for the reactants. The solvent (C') may be either (C') (1) alone or in combination with either (C')(2) or (C')(3), or the solvent (C') may be (C')(4) in combination with (C')(2) wherein:

(C')(1) is either (i) a polyhydric alcohol having 2 to 4 carbon atoms, (ii) a di-($C_3$ or $C_4$)glycol, (iii) a tri-($C_2$ to $C_4$)glycol or (iv) a mono- or poly-alkylene glycol alkyl ether of the formula:

$$R(OR^1)_xOR^2 \quad (XI)$$

wherein in the formula (XI) R is a $C_1$ to $C_6$ alkyl group, $R^1$ is hydrogen or a $C_1$ to $C_6$ alkyl group and x is an integer from 1 to 6. Suitable compounds having the formula (XI) include the monomethyl or dimethyl ethers of (a) ethylene glycol, (b) diethylene glycol, (c) triethylene glycol or (d) tetraethylene glycol. A suitable compound is methyl diglycol ($CH_3OCH_2CH_2OCH_2CH_2OH$). Mixtures of glycol ethers and glycols may also be employed. The polyhydric alcohol may suitably be either a dihydric alcohol, for example ethylene glycol or propylene glycol, or a trihydric alcohol, for example glycerol. The di-($C_3$ or $C_4$)glycol may suitably be dipropylene glycol, the tri-($C_2$ to $C_4$)glycol may suitably be triethylene glycol. Preferably the component (C')(1) is either ethylene glycol or methyl diglycol. (C')(2) is a hydrocarbon solvent which may be aliphatic or aromatic. Examples of suitable hydrocarbons include toluene, xylene, naphtha and aliphatic paraffins, for example hexane, and cycloaliphatic paraffins. (C')(3) may be either (i) water, (ii) a $C_1$ to $C_{20}$ monohydric alcohol, (iii) a ketone having up to 20 carbon atoms, (iv) a carboxylic acid ester having up to 10 carbon atoms or (v) an aliphatic, alicyclic or aromatic ether having up to 20 carbon atoms. Examples are methanol, 2-ethyl hexanol, cyclohexanol, cyclohexanone, benzyl alcohol, ethyl acetate and acetophenone. (C')(4) may be a $C_1$ to $C_4$ monohydric alcohol, preferably methanol. Preferred solvents (C') comprise ethylene glycol, a mixture of ethylene glycol and 2-ethyl hexanol and a mixture of methanol and toluene.

Component (D') is a lubricating oil. Suitable lubricating oils are as described hereinbefore with reference to the concentrate compositions.

Component (E') is carbon dioxide added subsequent to each addition of component (B'). Carbon dioxide may be added in the form of a gas or a solid, preferably in the form of a gas. In gaseous form it may suitably be blown through the reaction.

Component (F') is either (i) a carboxylic acid having the formula (I) or (ii) a di- or polycarboxylic acid containing from 36 to 100 carbon atoms, or an acid anhydride or ester derivative of either (i) or (ii). Suitable components (F') and amounts thereof are described hereinbefore with reference to component (b) of the additive concentrate.

Optional component (G') is a catalyst for the carbonation reaction. It is preferred that a catalyst be present for the achievement of higher TBN concentrates, for example TBNs greater than 350. The catalyst may be either an inorganic compound or an organic compound, preferably an inorganic compound. Suitable inorganic compounds include hydrogen halides, metal halides, ammonium halides, metal alkanoates, ammonium alkanoates or a mono-. di-, tri- or tetra-alkyl ammonium formate or alkanoate. As regards the metal moiety of the metal halides or metal alkanoates, this is suitably either zinc, aluminium, or an alkaline earth metal, for example calcium. A preferred metal moiety is calcium. As regards the halide moiety, the chloride is preferred. The alkanoate moiety is suitably a $C_2$ to $C_{10}$ alkanoate, preferably a $C_2$ to $C_4$ alkanoate, for example an acetate or propionate. When a substituted ammonium compound is used, it is preferably a tetra-($C_1$ to $C_4$ alkyl) ammonium compound, especially a tetramethylammonium compound such as tetramethylammonium acetate. Examples of suitable carbonation catalysts include calcium chloride, ammonium chloride, calcium acetate, ammonium acetate, zinc acetate, and tetramethylammonium acetate. Suitably the amount of catalyst employed may be up to 2.0% wt/wt. The catalyst facilitates the overbasing process and may have other benefits.

As regards component (A') of the alternative (i) to (iv) it is preferred to use (i) to (iii), of the alternatives (v) or (vi) it is preferred to use (v) and of the alternatives (vii) or (viii) it is preferred to use (vii). Of all the alternatives a preferred alternative is (v). As regards the order of addition, provided that the components, with the possible exception of component (D') are present before the addition of component (E') they may be added in any order. It is preferred however that component (A") be present from the start of the process, thus it is preferred as a first step to mix at least one of the components (A) (i) to (iii), (v) or (vii) with component (A").

Typically in one preferred method of producing a concentrate according to the present invention a first step comprises reacting at elevated temperature a mixture comprising a hydrocarbyl-substituted phenol unsubstituted at the ortho-positions, eg para-dodecyl phenol, an aldehyde, e.g. formaldehyde or one of its polymeric precursors, a hindered phenol or naphthol having antioxidant activity, e.g. 2,6-di-tertiary-butyl phenol, a catalytic amount of a base, e.g. sodium or potassium hydroxide and a solvent, e.g. xylene, to produce a product comprising a calixarene and a second step comprises reacting a mixture comprising calixarene-containing product from the first step, and components (B'), (C'), (D'), (F') and (G') at elevated temperature with component (E') in proportions such that there is produced a concentrate having a TBN greater than 300 and a viscosity at 100° C. of less than 1000 cSt.

Suitably the elevated temperature at which the process is operated may be a temperature in the range from 15° to 200° C., preferably from 50° to 175° C. The optimum temperature within the aforesaid range will depend amongst other things upon the nature of the solvent selected as component (C').

At the conclusion of the reaction it is preferred to recover the concentrate as a solution in lubricating oil by separating off the solvent (C') by, for example, distillation.

Finally, it is preferred to separate off any insoluble matter, suitably by filtration or centrifugation.

According to a further aspect of the present invention, there is provided a finished lubricating oil composition which composition comprises a major proportion of a lubricating oil and a minor proportion of an additive concentrate as hereinbefore described.

The amount of additive concentrate present in the finished lubricating oil will depend on the nature of the final use. Thus, for marine lubricating oils the amount of additive concentrate present may suitably be sufficient to provide a TBN of 9 to 100 and for automobile engine lubricating oils the amount may suitably be sufficient to provide a TBN of 4 to 20.

The finished lubricating oil may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the concentrate composition.

The invention will now be further illustrated by reference to the following Examples.

COMPARISON TEST 1

(A) Preparation of Calixarene

A 5-liter round bottom wide neck flask was charged with the product obtained by alkylating phenol with propylene tetramer (268 g, 66 weight % paradodecylphenol, 1 mole, 1 equivalent), paraformaldehyde (60 g, 2 moles, 2 equivalents), 10M aqueous sodium hydroxide catalyst (40 g, 0.4 mole, 0.4 equivalent) and xylene solvent (2 kg). The flask was connected to an apparatus including flange lid, overhead stirrer/paddle/gland, condenser, Dean and Stark trap and mantle/Eurotherm/thermocouple heating system. The apparatus above the mantle (including the Dean and Stark trap) was lagged and the reaction heated rapidly to 110° C. The temperature was then raised to 155° C. as reflux allowed (over 8 hours). Water was drained off via the Dean & Stark trap and a total of 70 ml was collected. When water ceased to be collected the reaction mixture was refluxed at 155° C. for 3 hours.

The reaction mixture was allowed to cool and, when cool enough to handle, 900 ml of the resulting solution was added to 600 ml of SN150 mineral oil and the xylene removed at 90° C./29 inches Hg on a rotary evaporator giving a clear solution of 15.7% by weight calixarene in mineral oil.

The remaining xylene solution was decanted off the black granular catalyst residues and stored.

(B) Overbasing of Calixarene to 400 TBN

A 1 liter wide neck round bottom flask was charged with the 15.7 weight % solution of calixarene in mineral oil product obtained in (A) above (132.6 g, 74 mmol, 1 equivalent), the product obtained by alkylating phenol with propylene tetramer as used in (A) above (9.0 g, 33.6 mmol, 0.45 equivalents), lime (90 g, 1.21 moles, 16.4 equivalents), stearic acid (100 g, 0.35 moles, 4.76 equivalents), calcium acetate (6 g, 38 mmol, 0.51 equivalents) and 2-ethylhexanol (222 g) solvent.

The flask was then incorporated into an apparatus including flange lid, clip, clamp, overhead stirrer/gland paddle, splash head/condenser/receiver adaptor/flask and mantle/Eurotherm/thermocouple heating system.

The stirrer was switched on and the reactor contents heated to 150° C./11 inches Hg for 30 minutes. Ethylene glycol (42 g) was then added and the reaction mixture was heated at 130° C./11 inches Hg for 15 minutes. The vacuum was broken and extra 2-ethyl hexanol (110 g) was added. The reaction mixture was then carbonated at 130° C. via a carbonation tube leading from solid carbon dioxide (120 g, 2.73 moles, 36.9 equivalents) in a sealed flask. After 90 minutes carbonation was complete and the vacuum was raised to 27 inches mercury at a rate such as to avoid violent frothing. The temperature was then raised to 210° C. and the solvent was removed. Upon removal of the solvent (after 30 minutes) the vacuum was broken and heating was stopped. The solids content of the product was measured at 3.6 weight %. The crude product was then filtered hot through a 1 inch pad of "Diff B" filteraid. The filtration rate was quick. The distillate weight was 364 g and the product yield 230 g.

EXAMPLE 1

The Comparison Test was repeated except that in (A) 5 weight % of the product obtained by alklylating phenol with propylene tetramer was replaced with 3,5-di-tertiary-butylphenol.

EXAMPLE 2

The Comparison Test was repeated except that in (A) 5 weight % of the product obtained by alkylating phenol with propylene tetramer was replaced with 2,4-di-tertiary-butyl phenol.

EXAMPLE 3

The Comparison Test was repeated except that 5 weight % of the product obtained by alkylating phenol with propylene tetramer was replaced with 2,6-di-tertiary-butylphenol.

EXAMPLE 4

(i) Preparation of 150 TBN Calcium P-dodecyl Sulphurised Phenate Incorporating 2,6-di-tertiary-butyl Phenol as 5% by Weight of the Alkyl Phenol Charge A 1-liter wide neck round bottom flask was charged with the product obtained by alkylating phenol with propylene tetramer (427.5 g, 66 weight % paradodecylphenol, 1.6 moles, 1 equivalent), 2,6-di-tertiary-butylphenol (22.5 g, 0.11 moles, 0.07 equivalents), SN150 mineral oil (254 g), lime (80 g, 1.11 moles, 0.7 equivalents) and sulphur (80 g, 2.5 moles, 1.56 equivalents).

The ingredients were heated with stirring to 160° C. at 4 inches Hg pressure and then ethylene glycol (4 g) was added. The temperature was raised to 180° C. and held at this temperature for 30 minutes before adding further ethylene glycol (48 g). The reactants were held for 30 minutes at 180° C. before applying full vacuum (27.5 inches mercury), and raising the temperature to 210° C. After removal of the solvent, the reactor was cooled and thereafter its contents were filtered through a celite pad.

(ii) Upgrade of 150 TBN Calcium P-dodecyl Sulphurised Phenate Incorporating 2,6-di-tertiary-butyl Phenol Product of (i) Above to 400 TBN An apparatus was set up including a 1 liter wide neck round bottom flask, flange lid, clip, clamp, overhead stirrer/gland/paddle, splash head/condenser/receiver adaptor/flask and mantle/eurotherm/thermocouple heating system. The flask was charged with the 150 TBN phenate product of (i) above (250 g, 60.2% SAP content, 0.5 mole SAP, 1 equivalent), stearic acid (69 g, 0.24 mole, 0.5 equivalent), lime (calcium hydroxide, 86 g, 1.1 moles, 2.3 equivalents), calcium acetate (6 g, 0.037 mole, 0.07 equivalent) and 2-ethylhexanol (30 g, solvent).

The pressure was reduced to 11 inches Hg and the reactants heated with stirring to 135° C. A further 80 g of 2-ethylhexanol was then added and the reactants held at 135° C./11 inches Hg for 10 minutes with stirring. Ethylene glycol (42 g, 0.677 mole, reactive solvent, excess) was then added and the reactants held at 135° C./11 inches Hg for a further 5 minutes. The vacuum was released and carbon dioxide (86 g, 1.95 moles, 4 equivalents) bubbled into the stirred reactants at 135° C. Once carbon dioxide addition was complete (roughly 1 hour) full vacuum (27 inches mercury) was gently applied and the temperature was raised to 210° C. The reactants were held at this temperature until distillation was complete (1 hour) and then sampled for sediment content. This was found to be 3% by weight. The crude product was then filtered hot through a 1 inch pad of "Diff B" filteraid. The distillate content was measured as 151.4 g and the product yield was 467.1 g.

The TBN values and the elemental analysis figures for the concentrates Examples 1 to 4 and Comparison Test 1 are given in Table 1. The viscosity as measured at 100° C. of all the concentrates was less than 1000 cSt.

TABLE 1

| Example | TBN | Sulphur (%) | Calcium (%) |
|---|---|---|---|
| Comp Test 1 | 389 | 0 | 13.6 |
| 1 | 375 | 0 | 13.7 |
| 2 | 385 | 0 | 13.7 |
| 3 | 383 | 0 | 13.4 |
| 4 | 381 | 3.13 | 13.4 |

EXAMPLES 5–8 AND COMPARISON TEST 2

The products of Comparison Test 1 and Examples 1 to 4 were subjected to a hot oil oxidation test (HOOT). The Total Acid Number (TAN), the viscosity at 100° C. or 40° C. (Kv) and the Infrared measurement of acids (QUIR) were measured after the HOOT test and are recorded in Table 2.

TABLE 2

| | | Hot Oil Oxidation Test | | |
|---|---|---|---|---|
| Example | Product | TAN | Kv | Qu |
| Comp Test 2 | Comp Test 1 | 10.9 | 42.4 | 421 |
| 5 | 1 | 9.1 | 33.3 | 352 |
| 6 | 2 | 10.6 | 31.3 | 347 |
| 7 | 3 | 10.35 | 30.7 | 340 |
| 8 | 4 | 10.45 | 36.0 | 358 |

With reference to Table 2 it can be seen that the incorporation before carbonation of di-tert-butylphenols into the high TBN calixarene-containing additive concentrate improves its antioxidancy properties (Comp Test 1 and Examples 1 to 3) as determined by the Hot Oil Oxidation Test.

COMPARISON TEST 3

Preparation of 400 TBN Calixarate Free from Hindered Phenol or Naphthol

The apparatus described in Comparison Test 1 (B) was set up and charged with a 50% solution in lubricating oil of a substantially pure dodecylcalixarene ex. Schenectady (123.0 g), stearic acid (85 g), dodecylphenol (9 g), lime (90 g), calcium acetate (6.0 g) and 2-ethyl hexanol (solvent, 222 g). The reactants were heated to 140° C., 10 inches Hg, for 30 minutes and thereafter ethylene glycol (42 g, reactive solvent) was added. The reaction mixture was cooled to 130° C./10 inches Hg and held at this temperature for 10 minutes. The vacuum was then broken and carbonation, using a heated flask containing solid carbon dioxide (120 g) leading to a dip tube into the vessel contents was begun at 130° C. and continued until all the carbon dioxide had evaporated (1 hour). Once carbonation was complete, full vacuum (30 inches Hg) was applied as quickly as distillation allowed, and the temperature was raised to 200° C. When all the solvent were removed the reactor contents were filtered hot through a ½ inch celite pad. Filtration was quick.

The product was a 17½% calixarene level 400 TBN calcium calixarate lubricating oil concentrate.

EXAMPLE 9

Preparation of 400 TBN Calixarate Incorporating Hindered Phenol having Antioxidant Activity Comparison Test 3 was repeated except that 20 mole % of the dodecylcalixarene was replaced by 2,6-di-tertiary butylphenol.

The product was a 17½% calixarene level 400 TBN calcium calixarate incorporating 2,6-di-tertiary butylphenol lubricating oil concentrate.

COMPARISON TEST 4 AND EXAMPLE 10

Hot Tube Test

The products of Comparison Test 3 and Example 9 were subjected to the standard Hot Tube Test. The results of this test are expressed in terms of a rating. A rating of greater than 8 signifies a pass.

The product of Comparison Test 3 was rated zero in the test, ie the antioxidant-free material failed the test. The product of Example 9 had a rating of 9 in the test, i.e. the concentrate incorporating the hindered phenol antioxidant passed the test.

The results demonstrate the improvement in antioxidancy properties consequent upon incorporating prior to carbonation a hindered phenol antioxidant into a 400 TBN calcium calixarate concentrate.

Test

The following products were subjected to a standard Roxana Test and a Hot Oil Oxidation Test:

(I) A 400 TBN calcium sulphurised alkyl phenate lubricating oil concentrate obtained by overbasing a preformed 250 TBN calcium sulphurised alkyl phenate, itself derived from the product obtained by alkylating phenol with propylene tetramer.

(II) The product obtained by blending (I) with 1% by weight of 3,5-di-tertiary butylphenol.

(III) A 400 TBN calcium sulphurised alkyl phenate lubricating oil concentrate obtained by overbasing the uncarbonated product obtained by neutralising with lime the product obtained by reacting sulphur with propylene tetramer-substituted alkylphenol.

(IV) A product identical to (III) except that 5 mole % of the propylene tetramer-substituted alkyl phenol is replaced with 3,5-di-tertiary butylphenol prior to reaction with lime to form the uncarbonated product.

(V) A product identical to (III) except that 5 mole % based on the alkylphenol of 3,5-di-tertiary butylphenol is added to the uncarbonated product prior to overbasing.

Products (I) to (III) are not products according to the present invention because they either do not incorporate a hindered phenol or naphthol antioxidant or they incorporate such an antioxidant by addition after carbonation. Products (IV) and (V) are according to the present invention.

The results of the Tests are given in Table 3.

TABLE 3

| Product | Roxana Deposits (mg) | Hot Oil Oxidation Test TAN | Kv (100) | Qu |
|---|---|---|---|---|
| (I) | 0.41 | 11.29 | — | 387 |
| (II) | 0.31 | 13.26 | 36.1 | 372 |
| (III) | 0.40 | 12.32 | — | 419 |
| (IV) | 0.19 | 10.93 | 38.9 | 369 |
| (V) | 0.30 | 10.30 | 39.2 | 390 |

With reference to Table 3 it is apparent that the concentrates not incorporating 3,5-di-tertiary-butylphenol ((I) and (III)) give the highest Roxana deposits, i.e. possess the lowest antioxidancy. Moreover, the concentrate providing the lowest Roxana deposits, i.e. the highest antioxidancy, is (IV) in which the 3,5-di-tertiary butylphenol is incorporated at the earliest stage in the process. The HOOT results generally conform with the conclusion that concentrates incorporating 3,5-di-tertiary butylphenol exhibit better antioxidancy than those not incorporating it and of those concentrates incorporating antioxidant those in which it is incorporated prior to carbonation are generally superior to that in which it is added after overbasing is complete.

I claim:

1. An additive concentrate suitable for incorporation in a finished lubricating oil composition, the additive concentrate comprising (a) a lubricating oil, and (b) a lubricating oil soluble detergent which is an overbased metal salt obtained by an overbasing process including a carbonation step and modified by reaction to incorporate from greater than 2 to less than 40% by weight based on the weight of the concentrate of either (i) at least one carboxylic acid having the formula (I):

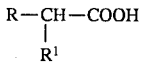

(I)

wherein R is a $C_{10}$ to $C_{24}$ alkyl or alkenyl group and $R^1$ is hydrogen, a $C_1$ to $C_4$ alkyl group or a $—CH_2—COOH$ group, or an anhydride or an ester derivative thereof, or (ii) a di- or polycarboxylic acid containing from 36 to 100 carbon atoms or an anhydride or an ester thereof, and further modified to incorporate by addition prior to carbonation a hindered phenol or naphthol having antioxidant activity.

2. An additive concentrate according to claim 1 having a TBN greater than 300.

3. An additive concentrate according to claim 1 wherein the detergent is an overbased metal salt of at least one of either (1) a hydrocarbyl-substituted phenol, (2) a sulphur-free calixarene having a substituent hydroxyl group or groups available for reaction with metal base, (3) a linear phenol/formaldehyde condensation product, (4) a hydrocarbyl-substituted sulphonic acid, (5) a hydrocarbyl-substituted naphthenic acid, (6) a hydrocarbyl-substituted salicylic acid or (7) a condensation product of either a hydrocarbyl-substituted sulphonic acid or a hydrocarbyl-substituted salicylic acid and an aldehyde.

4. An additive concentrate according to claim 1 wherein the detergent is an overbased metal salt of a sulphur-free calixarene of the formula (II):

(II)

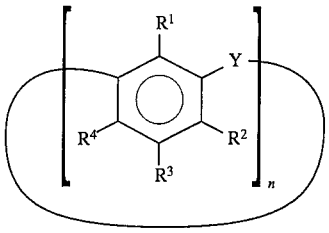

wherein Y is a divalent bridging group:

$R^3$ is hydrogen, a hydrocarbyl or a hetero-substituted hydrocarbyl group;

either $R^1$ is hydroxyl and and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; and n is an integer in the range from 4 to 20.

5. An additive concentrate according to claim 4 wherein in the formula (II) Y is $(CHR^6)_d$ in which $R^6$ is either hydrogen or hydrocarbyl, d is an integer which is at least one, and n is from 4 to 9.

6. An additive concentrate according to claim 1 wherein the detergent is an overbased metal salt of a sulphur-free calixarene of the formula (III):

(III)

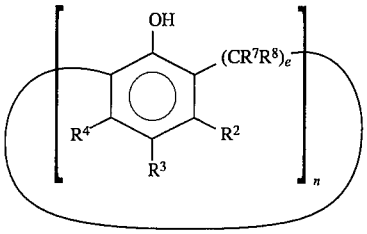

wherein $R^2$, $R^3$ and $R^4$ are independently either hydrogen, hydrocarbyl or hetero-substituted hydrocarbyl, either one of $R^7$ and $R^8$ is hydrogen and the other is either hydrogen or hydrocarbyl, n is an integer in the range 3 to 12, and e is one or greater.

7. An additive concentrate according to claim 1 wherein the detergent is an overbased metal salt of a sulphur-free calixarene which is either a nonyl, a tertiary-butyl, a dodecyl or a tertiary amyl calixarene.

8. An additive concentrate according to claim 7 wherein the sulphur-free calixarene is a para-dodecyl calixarene.

9. An additive concentrate according to claim 1 wherein the metal of the overbased metal salt is an alkaline earth metal.

10. An additive concentrate according to claim 9 wherein the metal of the overbased metal salt is calcium.

11. An additive concentrate according to claim 1 wherein there is incorporated at least one carboxylic acid having the formula (I) wherein R is a $C_{10}$ to $C_{24}$ straight-chain alkyl group and $R^1$ is hydrogen.

12. An additive concentrate according to claim 11 wherein the carboxylic acid having the formula (I) is stearic acid.

13. An additive concentrate according to claim 1 incorporating a hindered phenol having antioxidant activity which is a mononuclear phenol having the formula (VI):

(VI)

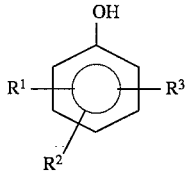

wherein $R^1$ and $R^2$ are independently hydrocarbyl groups and $R^3$ is either a hydrocarbyl group or hydrogen.

14. An additive concentrate according to claim 13 wherein the hindered phenol is a di-tert-butyl phenol.

15. An additive concentrate according to claim 13 wherein the hindered phenol is 2,6-di-tert-butyl phenol.

16. An additive concentrate according to claim 1 having a TBN of 400 or greater and comprising from 15 to 35% lubricating oil; from 5 to 30% dodecylcalixarene wherein from 5 to 30 mole % of the dodecylcalixarene is replaced by 2,6-di-tertiary butyl phenol; from 10 to 35% of a carboxylic acid having the formula (I) wherein R is a $C_{18}$–$C_{24}$ straight-chain alkyl group and $R^1$ is hydrogen; and from 10 to 20% alkaline earth metal, all percentages other than that of the 2,6-di-tertiary butyl phenol, being by weight based on the weight of the concentrate.

17. A process for the production of an additive concentrate as claimed in claim 1 which process comprises reacting at elevated temperature:

Component (A') at least one of (i) at least one of a sulphurised hydrocarbyl-substituted phenol, sulphonic acid, salicylic acid or naphthenic acid, (ii) at least one of a non-sulphurised hydrocarbyl-substituted phenol, sulphonic acid, salicylic acid or naphthenic acid, (iii) at least one of a non-sulphurised hydrocarbyl-substituted phenol, sulphonic acid, salicylic acid or naphthenic acid and a source of sulphur, (iv) at least one sulphurised or non-sulphurised hydrocarbyl-substituted phenate, sulphonate, salicylate or naphthenate having a TBN lower than that of the concentrate, (v) at least one calixarene product obtained by reacting a hydrocarbyl-substituted phenol unsubstituted at the ortho-positions, an aldehyde and as catalyst for the reaction a base, (vi) at least one calixarate having a TBN lower than that of the concentrate, (vii) at least one linear phenol/formaldehyde product obtained by reacting a mixture comprising a hydrocarbyl-substituted phenol, formaldehyde and as catalyst for the reaction a base, (viii) at least one metal salt of a linear phenol/formaldehyde product having a TBN lower than that of the concentrate, (ix) the product obtained by reacting either a hydrocarbyl-substituted sulphonic acid or salicylic acid, an aldehyde and as catalyst for the reaction a base, or (x) at least one metal salt of the product of (ix) having a TBN lower than that of the concentrate:

component (A") a hindered phenol or naphthol having antioxidant activity.

component (B') a metal base added either in a single addition or in a plurality of additions at intermediate points during the reaction;

component (C') a solvent comprising either:

(1) either:

(i) a polyhydric alcohol having 2 to 4 carbon atoms, (ii) a di-($C_3$ or $C_4$)glycol, (iii) a tri-($C_2$–$C_4$)glycol, or (iv) a mono- or poly-alkylene glycol alkyl ether of the formula:

$$R(OR^1)_xOR^2 \quad \text{(XI)}$$

wherein in the formula (XI) R is a $C_1$ to $C_6$ alkyl group, $R^1$ is an alkylene group, $R^2$ is hydrogen or a $C_1$ to $C_6$ alkyl group and x is an integer of from 1 to 6, either alone or in combination with either (2) a hydrocarbon solvent or (3) either (a) water, (b) a $C_1$ to $C_{20}$ monohydric alcohol, (c) a ketone containing up to 20 carbon atoms, (d) a carboxylic acid ester containing up to 10 carbon atoms or (e) an aliphatic, alicyclic or aromatic ether containing up to 20 carbon atoms or, (4) a $C_1$ to $C_4$ monohydric alcohol in combination with a hydrocarbon solvent (2);

component (D') a lubricating oil:

component (E') carbon dioxide added subsequent to each addition of component (B');

component (F') either (i) at least one carboxylic acid having the formula:

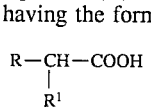

(I)

wherein R is a $C_{10}$ to $C_{24}$ alkyl or alkenyl group and $R^3$ is hydrogen, a $C_1$ to $C_4$ alkyl group or a $—CH_2—COOH$ group, or an anhydride or an ester derivative thereof, or (ii) a di- or polycarboxylic acid containing from 36 to 100 carbon atoms or an anhydride or an ester thereof, provided that component (A'), (A"), (B'), (C') and (F') are added prior to addition of component (E').

18. A process according to claim 17 wherein there is employed component (G').

19. A process according to claim 17 wherein component (A") is present from the start of the process.

20. A process according to claim 17 wherein a first step comprises reacting at elevated temperature a mixture comprising a hydrocarbyl-substituted phenol unsubstituted at the ortho-positions, an aldehyde, a hindered phenol or naphthol having antioxidant activity, a catalytic amount of a base and a solvent to produce a product comprising a calixarene and a second step comprises reacting a mixture comprising calixarene-containing product from the first step and components (B'), (C'), (D'), (F') and (G') at elevated temperature with component (E') in proportions such that there is produced a concentrate having a TBN greater than 300 and a viscosity at 100° C. of less than 1000 cSt.

21. A finished marine lubricating oil composition comprising a lubricating oil and an amount of additive concentrate as claimed in claim 1 sufficient to provide a TBN of from 9 to 100.

22. A finished automobile engine lubricating oil comprising a lubricating oil and an amount of additive concentrate as claimed in claim 1 sufficient to provide a TBN of from 4 to 20.

23. An additive concentrate according to claim 1, having a viscosity measured at 100° C. of less than 1000 cSt.

24. An additive concentrate according to claim 1, having a viscosity measured at a 100° C. of less than 750 cSt.

25. An additive concentrate according to claim 1, having a viscosity measured at a 100° C. of less than 500 cSt.

26. An additive concentrate according to claim 1, wherein said acid (i) or (ii) is incorporated in an amount of greater than 10 to 35% by weight based on the weight of the concentrate.

27. An additive concentrate according to claim 26, wherein said amount of acid (i) or (ii) is 12 to 20% by weight based on the weight of the concentrate.

28. An additive concentrate according to claim 27, wherein said amount of said acid (i) or (ii) is about 16% by weight based on the weight of the concentrate.

29. An additive concentrate according to claim 1, wherein said hindered phenol is a mononuclear phenol or a polynuclear phenol.

30. An additive concentrate according to claim 29, wherein said mononuclear phenol has the formula:

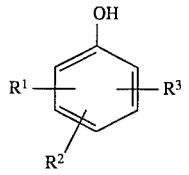

wherein $R^1$ and $R^2$ are independently hydrocarbyl groups and $R^3$ is hydrogen or a hydrocarbyl group.

31. An additive concentrate according to claim 30, wherein at least one of $R^1$, $R^2$ and $R^3$ is a tertiary alkyl group.

32. A process according to claim 17, wherein component (G') a catalyst for the carbonation reaction is added prior to addition of component (E').

* * * * *